US010546443B2

(12) United States Patent
Michels et al.

(10) Patent No.: US 10,546,443 B2
(45) Date of Patent: Jan. 28, 2020

(54) CASH BOX WITH DUAL-ROLL STORAGE SYSTEM

(71) Applicant: Wincor Nixdorf International GmbH, Paderborn (DE)

(72) Inventors: Andre Michels, Borgentreich-Grosseneder (DE); Guenter Baitz, Berlin (DE); Uwe Krueger, Berlin (DE); Wolfgang Malke, Berlin (DE)

(73) Assignee: Wincor Nixdorf International, GmbH, Paderborn (DE)

( * ) Notice: Subject to any disclaimer, the term of this patent is extended or adjusted under 35 U.S.C. 154(b) by 369 days.

(21) Appl. No.: 15/280,338

(22) Filed: Sep. 29, 2016

(65) Prior Publication Data

US 2017/0018134 A1 Jan. 19, 2017

Related U.S. Application Data

(62) Division of application No. 14/241,659, filed as application No. PCT/EP2012/066316 on Aug. 22, 2012, now Pat. No. 9,514,592.

(30) Foreign Application Priority Data

Aug. 30, 2011 (DE) ..... 10 2011 053 101

(51) Int. Cl.
*G07D 11/13* (2019.01)
*G07D 11/12* (2019.01)
(Continued)

(52) U.S. Cl.
CPC ..... *G07D 11/13* (2019.01); *B65H 29/006* (2013.01); *G07D 11/00* (2013.01);
(Continued)

(58) Field of Classification Search
CPC ..... B65H 29/006; B65H 2301/41912; B65H 2701/1912; G07D 11/00; G07D 11/0006;
(Continued)

(56) References Cited

U.S. PATENT DOCUMENTS 6,164,585 A 12/2000 Lutz
6,186,339 B1 2/2001 Saltsov et al.
(Continued)

FOREIGN PATENT DOCUMENTS

DE 19732129 A1 1/1999
DE 102006060619 A1 6/2008
(Continued)

OTHER PUBLICATIONS

International Preliminary Report on Patentability for International Application No. PCT/EP2012/066316 dated Mar. 4, 2014 (8 pages).
(Continued)

*Primary Examiner* — William L Miller
(74) *Attorney, Agent, or Firm* — Black, McCuskey, Souers & Arbaugh, LPA

(57) ABSTRACT

The invention relates to apparatus having a cash box device (100, 500) that comprises a housing (106) in which two roll storage systems (102, 104) for storing bank notes are held.

13 Claims, 8 Drawing Sheets

(51) Int. Cl.

| | |
|---|---|
| ***G07D 11/14*** | (2019.01) |
| ***G07D 11/16*** | (2019.01) |
| ***B65H 29/00*** | (2006.01) |
| ***G07D 11/00*** | (2019.01) |
| ***G07D 13/00*** | (2006.01) |

(52) U.S. Cl.
CPC ..... *G07D 11/0096* (2013.01); *G07D 11/12* (2019.01); *G07D 11/14* (2019.01); *G07D 11/16* (2019.01); *G07D 13/00* (2013.01); *B65H 2301/41912* (2013.01); *G07D 2211/00* (2013.01)

(58) Field of Classification Search
CPC ..... G07D 11/0012; G07D 11/0018; G07D 11/0021; G07D 11/0096; G07D 13/00; G07D 2211/00; G07D 11/13; G07D 11/12; G07D 11/16; G07D 11/14; G07F 9/04
USPC ..... 232/1 D, 15, 16; 242/528; 221/71; 194/350; 209/534
See application file for complete search history.

(56) References Cited

U.S. PATENT DOCUMENTS

| | | | | |
|---|---|---|---|---|
| 6,968,997 | B2 * | 11/2005 | Nomiyama | G06Q 20/1085 235/375 |
| 7,654,485 | B2 * | 2/2010 | Rossel | B65H 5/28 242/528 |
| 8,181,766 | B2 | 5/2012 | Michels | |
| 8,186,673 | B2 | 5/2012 | Michels | |
| 8,297,547 | B2 | 10/2012 | Michels et al. | |
| 8,413,919 | B2 | 4/2013 | Michels | |
| 8,628,081 | B2 | 1/2014 | Michels et al. | |
| 8,725,297 | B2 * | 5/2014 | Oishi | B65H 29/006 194/203 |
| 2003/0111395 | A1 | 6/2003 | Aas et al. | |
| 2004/0173708 | A1 | 9/2004 | Neumann et al. | |
| 2008/0149698 | A1 | 6/2008 | Gauselmann | |
| 2010/0072220 | A1 | 3/2010 | Michels | |
| 2010/0116839 | A1 | 5/2010 | Michels | |
| 2010/0181161 | A1 | 7/2010 | Gauselmann | |
| 2011/0017766 | A1 | 1/2011 | Michels et al. | |
| 2013/0036951 | A1 | 2/2013 | Dietz et al. | |

FOREIGN PATENT DOCUMENTS

| | | | |
|---|---|---|---|
| DE | 102007022556 | A1 | 11/2008 |
| EP | 1291831 | A2 | 3/2003 |
| EP | 1772406 | A1 | 4/2007 |
| WO | WO-2008138438 | A1 | 11/2008 |
| WO | WO-2010061160 | A1 | 6/2010 |

OTHER PUBLICATIONS

International Search Report (in German with English Translation) and Written Opinion (in German) for PCT/EP2012/066316, dated Nov. 27, 2012; ISA/EP.
German Search Report (in German) for DE 10 2011 053 101.7, dated Apr. 2, 2012.

* cited by examiner

CASH BOX WITH DUAL-ROLL STORAGE SYSTEM

CROSS-REFERENCE TO RELATED APPLICATIONS

This is a divisional patent application of U.S. application Ser. No. 14/241,659 filed Apr. 15, 2014 which is 371 of International Application No. PCT/EP2012/066316, filed Aug. 22, 2012, and published in German as WO/2013/030055 A1 on Mar. 7, 2013. This application claims the benefit and priority of German Application 10 2011 053 101.7, filed Aug. 30, 2011. The entire disclosures of the above applications are incorporated herein by reference.

BACKGROUND

This section provides background information related to the present disclosure which is not necessarily prior art.

Technical Field

The invention relates to a cash box that comprises a housing and a roll storage system located within this housing to store bank notes. The invention further relates to a device for handling bank notes that comprises an input and/or output unit for depositing and/or dispensing bank notes, a receiving area to receive a cash box, and a feed and/or removal unit to feed banknotes to the cash box or remove banknotes from the cash box, respectively.

Discussion

Cash boxes are used in particular to transport bank notes and/or to store bank notes, having a housing that prevents access to the bank notes, wherein a receiving area is provided in the housing to receive the bank notes. Cash boxes are known firstly in which the bank notes are received in stacked form as a bundle of bank notes, specifically standing on edge, and secondly cash boxes in which roll storage systems are used to store the bank notes. In the case of roll storage systems, the bank notes are received in succession between two film tapes and, together with the film tapes, spooled onto a winding drum. A roll storage system of this type is known from document DE 10 2007 022 556 A1.

Cash boxes are used in particular in devices for handling bank notes, for example in automated teller machines, in automated cash register systems and/or in automated safes in which bank notes can be conveyed to the cash boxes and/or bank notes can be removed from the cash boxes. After a cash box has been completely filled and/or completely emptied, it is transported from the device for handling bank notes to a cash center for filling and/or emptying.

The problem with using roll storage systems is that the bank notes can be saved only in accordance with the "first in, last out" (FILO) system so that in the case of mixed bank note storage, i.e. bank notes of several denominations are accepted, not each requested disbursal amount can be paid out and/or buffer storage must be provided in which the bank notes required for the disbursal of the corresponding amount can be held so that access to the necessary banknote is possible. In order to store bank notes in unmixed batches, an individual cash box has to be provided for each denomination so that, for example, seven cash boxes, each with a roll storage system, are required for unmixed storage of Euro bank notes. This is extremely space-intensive, whereas the space available in the case of these devices is very limited so that often only the most common denominations can be stored unmixed and larger denominations in particular are stored in a common cash box and are not available for disbursal again.

SUMMARY OF THE INVENTION

An object of the invention is to cite a cash box and a device for handling bank notes with the aid of which simple, effective storage of bank notes is possible.

In accordance with the invention, a second roll storage system is provided inside the housing of the cash box for storing bank notes so that one cash box comprises two roll storage systems. The effect of this is that bank notes of two different denominations can be stored unmixed using only one cash box. The advantage is that a greater number of denominations can be stored using a smaller number of cash boxes. It is therefore not absolutely necessary to provide interim storage in which, as in the case of mixed storage, bank notes have to be buffered in order to be able to remove a required bank note from the cash box. At the very least, fewer bank notes have to be transported in buffer storage of this kind.

The dimensions of the housing correspond specifically to the dimensions of standard cash boxes that contain only one roll storage system. The effect is that with the same space requirement, two separate roll storage systems which can be filled with bank notes are provided and thus two denominations can be stored unmixed. The cash box is specifically configured such that it can easily be handled manually, specifically carried by hand. A cash box is explicitly understood not to be automated teller machines, automated cash register systems and/or automated safes that, in contrast to a cash box, cannot be handled, specifically carried, by a single person. The cash box preferably weighs in the range between 2 kg and 25 kg.

In a preferred embodiment, the first roll storage system comprises a first winding drum, a first film reel, a second film reel, a first film tape attached to the first winding drum and the first film reel and a second film tape attached to the first winding drum and the second film reel. Likewise, the second roll storage system comprises a second winding drum, a third and a fourth film reel, a third film tape attached to the second winding drum and the third film reel and a fourth film tape connected to the second winding drum and the second film reel. The bank notes to be stored on the respective roll storage system are received between the two film tapes of this roll storage system, wherein the film tapes are unwound from the corresponding film reels and wound onto the winding drum so that the bank notes are also wound onto the winding drum. In order to remove the bank notes, the film tapes are again unwound from the winding drum onto the corresponding film reels so that the bank notes are released from the film tapes again. In an especially preferred embodiment each roll storage system comprises not just two film tapes, but four film tapes and four film reels, wherein two film tapes are carried each time in parallel and one bank note contacts the two other film tapes opposite on the same side of the bank note. In this case specifically, two of the film reels are carried each time on a common spindle and are wound and unwound at the same rate.

The housing specifically has a wall in which a first and second slot are provided whereby the bank notes can be taken to the first roll storage system via the first slot or bank notes removed from the first roll storage system can be transported out of the cash box and the bank notes can be taken to the second roll storage system via the second slot and the bank notes removed from the second roll storage system can be removed from the cash box.

The first and the second roll storage systems are specifically configured totally separate from each other, i.e. no components are used from both roll storage systems. Specifically, each roll storage system has its own drive unit to rotate the winding drum. Furthermore, the two roll storage systems can preferably be driven independently of each other.

In an alternative embodiment of the invention, only one slot may be provided in the wall through which the bank notes can be fed to the two roll storage systems or the bank notes removed from the two roll storage systems can be transported from the cash box. In this case, a switching array is specifically located inside the housing of the cash box via which the bank notes can be taken to either of the two roll storage systems.

The switching array specifically comprises a switching element that, in a first switching position, directs the bank notes fed through the slot onto a first path to guide bank notes to a first roll storage system. In a second switching position on the other hand, the switching element directs the bank notes fed through the slot onto a second path that leads to the second roll storage system. Correspondingly, bank notes removed from the first roll storage system can be taken to the slot with the switch in the first position and thus out of the cash box. In order to remove bank notes received in the second roll storage system, the switching system is positioned in the second switch position so that the bank notes can similarly only be removed through the one slot of the housing.

In a particularly preferred embodiment, a first and a second pair of rollers is provided, wherein the first film tape is carried over a first roller of the first pair of rollers and the second film tape is carried over a second roller of the first pair of rollers. Accordingly, the third film tape is carried over a third roller of the second pair of rollers and the fourth film tape is carried over a fourth roller of the second pair of rollers. The switch array is configured in such a way that, in the first switch position, it takes the bank notes introduced by way of the slot to the first pair of rollers in such a way that the bank notes are arranged between the first and second film tape. In the second switch position, however, the switch array takes the bank notes introduced by way of the slot to the second pair of rollers in such a way that the bank notes are arranged between the third and fourth film tape. In this way, the bank notes can be stored on the first winding drum by suitably spooling the first film tape and the second film tape, or on the second winding drum by spooling the third film tape and the fourth film tape.

Compared with the version with two slots, the embodiment with only one slot and a switch gear for optionally taking the bank notes brought in over the only one slot to the two roll storage systems has the advantage that a device for handling bank notes in which the cash box to be filled with bank notes and/or from which of bank notes are to be removed requires only one feed and/or removal unit for feeding bank notes to or removing bank notes from both roll storage systems. The end result is a particularly compact and simple construction.

A particularly advantageous aspect is that the cash box with the two roll storage systems can be accommodated in this way in the same receiving areas as the known cash boxes with only one roll storage system. To achieve this, the single slot of the cash box with the two roll storage systems is arranged in such a way that said slot has the same position as the slot of the cash box having only one roll storage system so that the same feed and/or removal unit can be used. Specifically what this achieves is that only the software for operating the device for handling bank notes has to be adapted to the new type of cash boxes with the two roll storage systems, whereas the hardware can remain unchanged. This achieves what is known as downward compatibility, i.e. the new cash boxes with the two roll storage systems can be used without difficulty in existing devices for handling bank notes, for example automated teller machines, without requiring structural changes to the device for handling bank notes.

The first and the second slot are specifically arranged at a preset distance to each other on the same side of the housing. The distance between the two slots is specifically between 6 cm and 10 cm, preferably between 8 cm and 9 cm.

In a preferred embodiment, a first and a second pair of rollers are provided in the cash box, wherein the first film tape is guided over a first roller of the first pair of rollers and the second film tape is guided over a second roller of the first pair of rollers, the third film tape over a third roller of the second pair of rollers and the fourth film tape over a fourth roller of the second pair of rollers. Bank notes introduced through the first slot are guided through the rollers of the first pair of rollers so that they are thereby accepted between the first and second film tape guided over the rollers of the pair of rollers and are transported towards the winding drum as the two film tapes are transported. Correspondingly, the bank notes fed in by way of the second slot are taken between the rollers of the second roll system storage so that the bank notes are arranged between the third and the fourth film tape. The first pair of rollers is specifically placed for this purpose adjacent to the first slot on the inner side of the housing, wherein the second pair of rollers is arranged correspondingly adjacent to the second slot on the inner side. The end effect is that the bank notes can be easily be taken to both the first and to the second roll storage system without their impeding each other. It is in fact possible for bank notes to be taken simultaneously to the first and to the second roll storage system.

The first film reel is specifically located between the first winding drum and the first pair of rollers, whereas the second film reel is located is located on the side of the first winding drum facing away from the first pair of rollers. Thus, the two film reels are arranged on opposite sides of the winding drum so that an especially space-saving construction is achieved and, in spite of providing two roll storage systems in only one housing, both roll storage systems have a greatest possible maximum volume for holding bank notes.

Correspondingly, the third film reel is arranged between the second winding drum and the second pair of rollers and the fourth film reel on the side of the second winding drum facing away from the second pair of rollers so that, here too, a particularly compact construction is achieved.

The first film tape, the second film tape, the third film tape and the fourth film tape are guided specifically via at least one deflection element from the respective film reel to the respective pair of rollers. This also makes compact construction of the cash box possible since no straight-line connection between the film reel and the pair of rollers is needed, but the film tape can be taken past other components, specifically around the winding drum. In a particularly preferred embodiment several deflecting elements are provided which can, for example, be configured as rollers.

The second film tape is preferably taken past the first winding drum at a predetermined angle, wherein this predetermined angle preferably has a value between 10° and 180°, specifically between 90° and 150°. Correspondingly, the fourth film tape is taken past the second winding drum with the aid of at least one idler pulley preferably at a predetermined angle, specifically at an angle of 120° and 270°, preferably 190° and 230°. This method of taking the film tapes over the idler pulleys past the winding drums also achieves a particularly compact construction because as a result the film reels, as seen from the pairs of rollers, can be located behind the winding drums. Leading the film tapes past the winding drums is understood to mean that the film tapes do not contact the winding drum and are led around it at a predetermined distance.

The first winding drum is specifically located at a first distance from the first slot and the second winding drum at a second distance from the second slot, where the second distance is greater than the first distance. The difference between the two distances specifically has a value that corresponds to the maximum diameter that the winding drum has when the maximum number of bank notes receivable has been wound onto it. In addition, it is ensured that even when the maximum number of bank notes has been wound onto both winding drums, the winding drums, or rather the bank notes and film tapes, do not make mutual contact and thus interfere with each other. The distance between the center axes of the winding drums specifically has a value between 7 cm and 10 cm.

A further aspect of the invention relates to a device for handling bank notes that comprises an input and/or output unit to input and/or output bank notes to an operator, a receiving area to accommodate a cash box previously described with two roll storage systems as well as a first feed and/or removal unit to feed and/or remove bank notes through the first slot of the cash box and a second feed and/or removal unit to feed or remove bank notes through the second slot of the cash box. The device further has a transport unit to transport the bank notes between the input and/or output unit and the feed and/or removal units. The device for handling bank notes is specifically an automated teller machine, an automated cash register system and/or an automated safe. By providing two feed and/or removal units it is ensured that bank notes can be fed to or removed from both roll storage systems in the cash box separately from one another through the respective slot so that bank notes can be stored easily on both roll storage systems.

In an alternative embodiment, only one feed and/or removal unit for feeding and/or removing bank notes can be assigned to each receiving area of the device for handling bank notes. In this embodiment specifically only cash boxes with two roll storage systems are used that, as previously described as an embodiment, have only one slot for feeding and removing banknotes and have a set of points in the interior for distributing the bank notes to the two roll storage system of the cash box.

Alternatively, it is equally possible that cash boxes with only one slot for both roll storage systems are used in the device described previously with two feed and/or removal units for each receiving area. In this case, both the bank notes that are to be accommodated in the first roll storage system as well as the bank notes that are to be accommodated in the second roll storage system are fed through the first feed and/or removal unit through the single slot of this cash box.

Overall, a great potential for adapting to customers' individual requirements is achieved through the previously described cash boxes and devices for handling bank notes. Furthermore, a high measure of compatibility between different devices and cash boxes is ensured so that new cash boxes with dual roll storage systems can be used without difficulty in existing devices.

The device comprises in particular a control unit with the aid of which the feed and/or removal units and/or the transport unit can be actuated. The control unit actuates the transport unit and the feed and/or removal unit specifically in such a way that there is unmixed storage of bank notes, i.e. only bank notes of a single denomination are accepted on each roll storage system of the cash box. What this achieves is that bank notes of both denominations can be removed directly without, as with mixed storage, possibly first having to remove other bank notes that have a denomination differing from the desired denomination.

The receiving area in particular is configured in such a way and the first feed and/or removal unit in particular is located in such a way that, as an option, a cash box of the type previously described with two roll storage systems or a traditional cash box with only one roll storage system can be housed in one receiving area, wherein the bank notes can be fed to or removed from the cash box with only one roll storage system through the first feed and/or removal unit. The result is that the device can be optionally equipped with cash boxes having two roll storage systems as well as with cash boxes having only one roll storage system so that by this means the number of the available roll storage systems and/or the available receiving volume can be easily adapted to individual requirements. By providing two feed and/or removal units and configuring the receiving area in such a way that both types of cash box can be accommodated, no structural modifications to the devices are necessary.

A further aspect of the invention relates to an array that comprises a device described previously and a cash box described previously having two roll storage systems, wherein the cash box is accommodated in the receiving area of the device. The device specifically has a safe in which the receiving area is located and in which the cash box is thus located. The device specifically has a plurality of receiving areas in each of which a respective cash box is accommodated.

In a particularly preferred embodiment, a cash box with two roll storage systems is located in a first receiving area on the array and an additional cash box having only one roll storage system in a second receiving area. The dimensions of the housings of the two cash boxes are specifically the same, wherein the maximum holding capacity for bank notes in the cash box with two roll storage systems is less than that of the cash box with the single roll storage system. Specifically, about one third of the banknotes can be stored on the two roll storage systems of the cash box having two roll storage systems that can be stored on the roll storage system of the cash box with only a single roll storage system. What is achieved by the cash box with the two roll storage systems is that a greater number of denominations can be stored unmixed, whereas the maximum number of bank notes that can be held is smaller.

In addition and as an alternative, cash boxes can also be accommodated in the device in which the bank notes are held in stacked form as a bundle of bank notes.

BRIEF DESCRIPTION OF THE DRAWINGS

Additional features and advantages of the invention emerge from the following description that explains the invention more thoroughly using embodiments in conjunction with the appended Figures.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
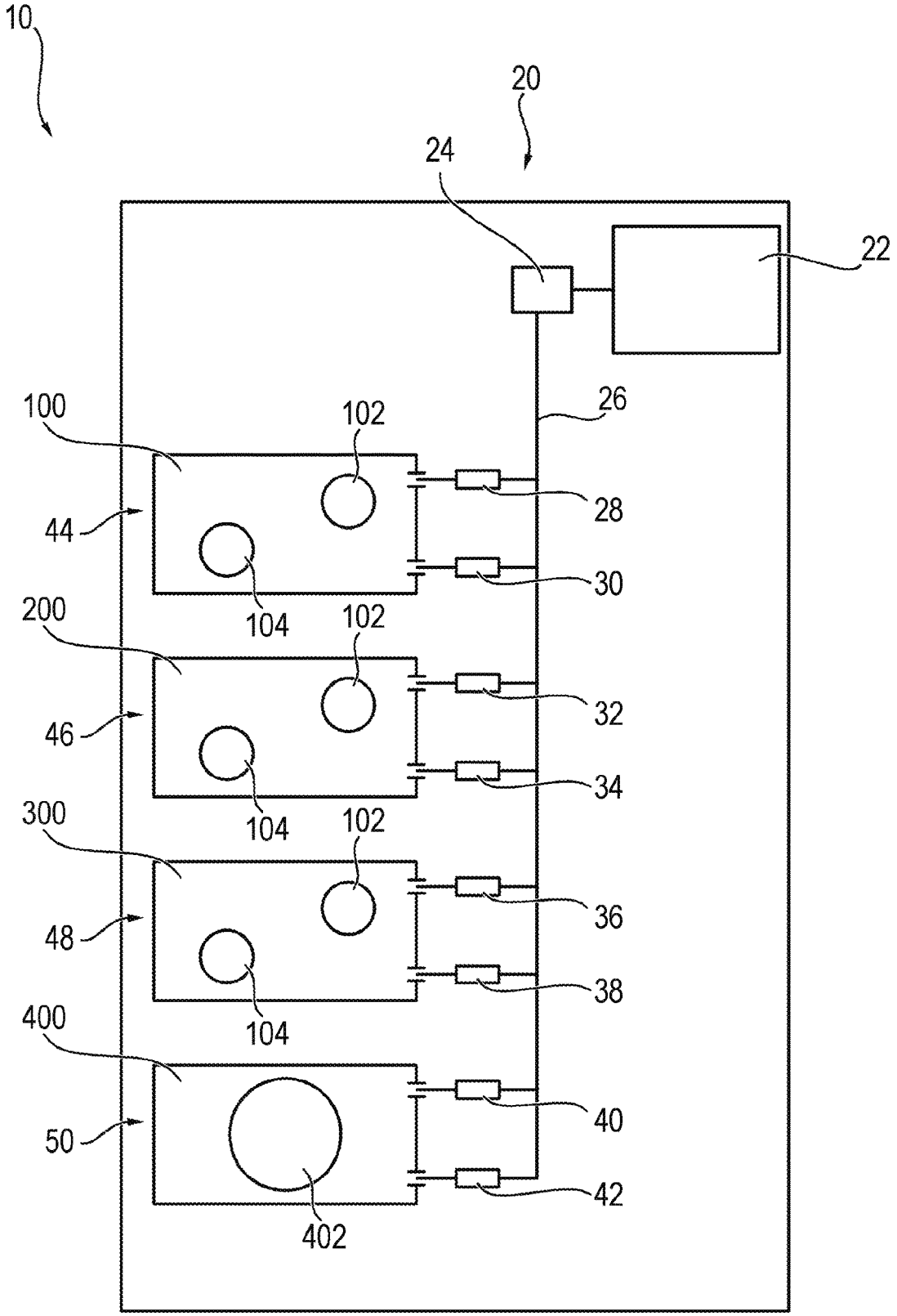
FIG. 1 shows a schematic representation of an array with a cash register system in accordance with a first embodiment and four cash boxes.
Figure 2:
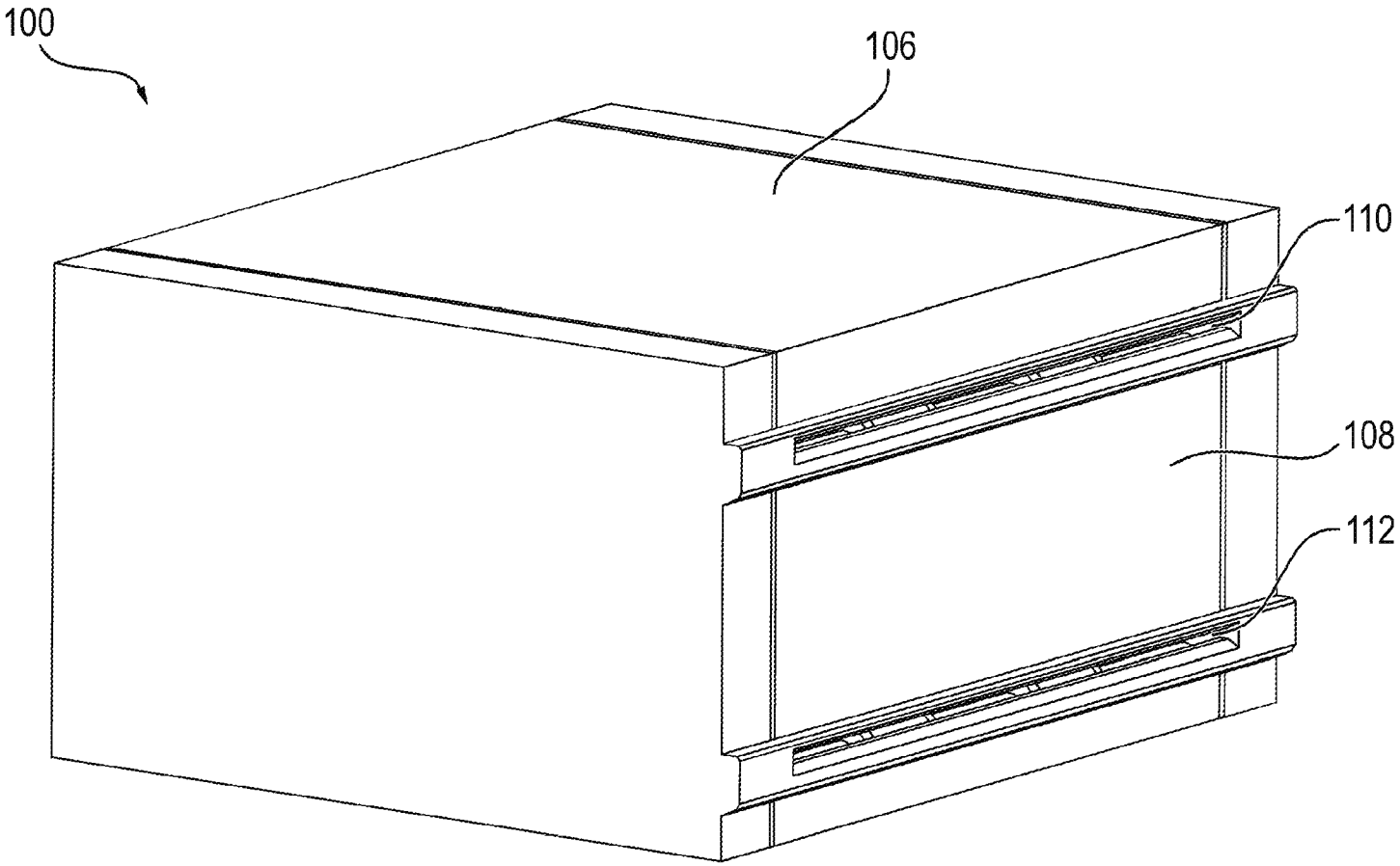
FIG. 2 shows a schematic, perspective representation of a cash box in accordance with a first embodiment.
Figure 3:
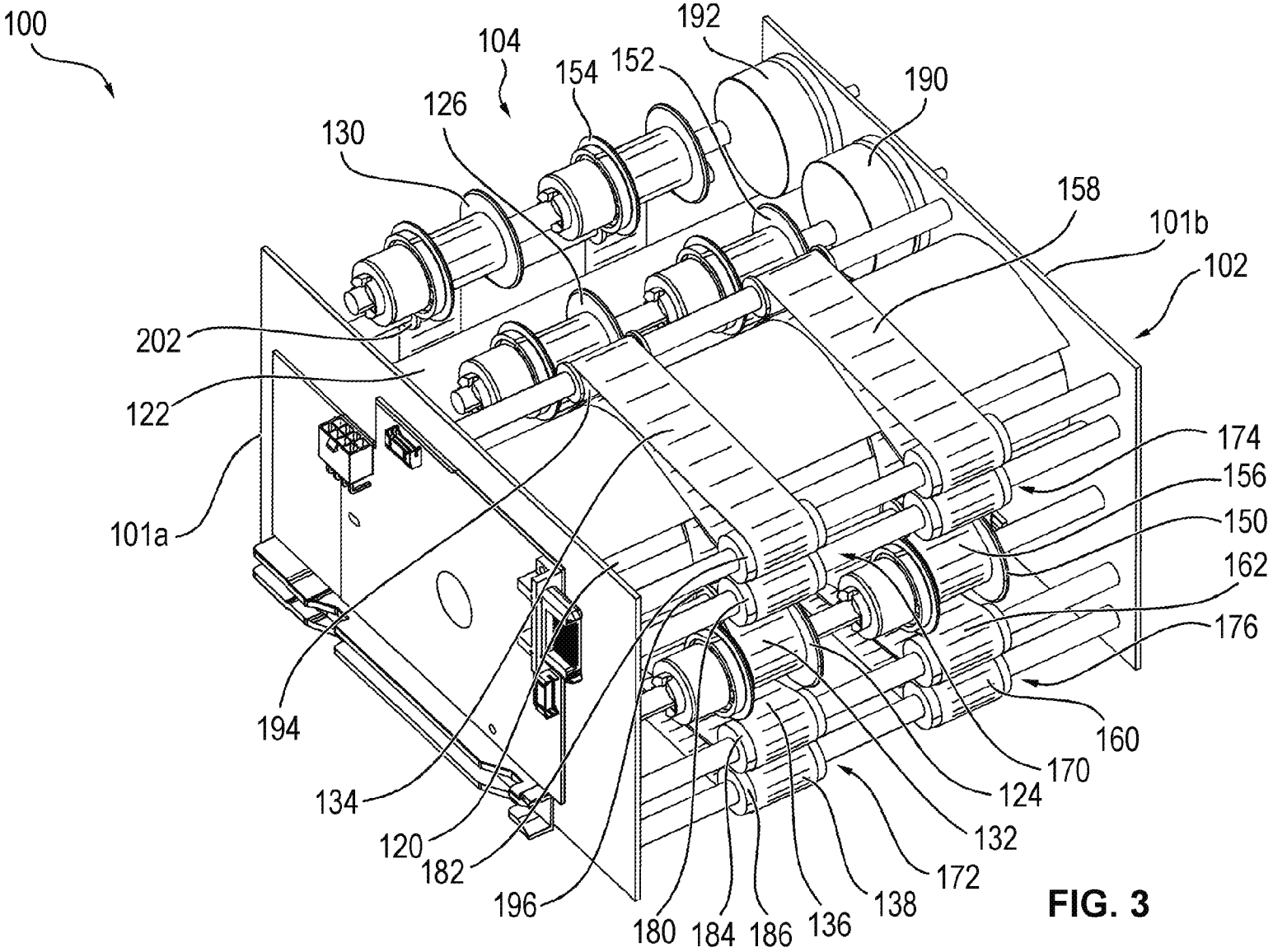
FIG. 3 shows a schematic, perspective representation of the cash box from FIG. 2 without the housing.

A schematic representation of an array 10 is shown in FIG. 1, comprising a device 20 configured as an automated cash register system 20 for handling bank notes in accordance with a first embodiment and four cash boxes 100, 200, 300, 400 housed in receiving areas of the device. Alternatively, the device 20 can also be an automated safe or an automated teller machine.

The device 20 comprises an input and output unit 22, with the aid of which the bank notes can be input into the device 20 and output from the device 20. In an alternative embodiment, only an input unit can be provided by way of which bank notes can only be input, or only an output unit by way of which bank notes can only be output. Furthermore, as an alternative, separate input and output units can be used for inputting or outputting.

After the validity of the banknotes that have been input and/or their denomination has been sequentially determined with the aid of a sensor unit 24, the banknotes are taken by way of a transport unit 26 and feed and removal units 28 to 42 to the cash boxes 100, 200, 300, 400 and received therein. The device 20 comprises in particular a control unit that divides the bank notes in accordance with a predetermined distribution among the individual cash boxes 100, 200, 300, 400 depending on the denominations determined. To do this, the control unit activates the transport unit 26 and the feed and removal units 26 to 42 accordingly. The device 20 has four receiving areas 44 to 50 in which exactly one cash box 100, 200, 300, 400 can be accommodated. Rails are provided in the receiving areas 44 to 50 into which the cash boxes 100, 200, 300, 400 can be pushed and by which the cash boxes 100, 200, 300, 400 are retained securely. In addition, preferably at least one connector is located in each receiving area by way of which a connection can be created to a complementary plug connection on the cash box 100, 200, 300, 400 through which an electrical connection can be formed to the cash box 100, 200, 300, 400 so that the cash boxes 100, 200, 300, 400 can be controlled by the control unit in the device 20.

Two feed and removal units 28 to 42 are allocated to each receiving area 44 to 50. The feed and removal units 28 to 42 are specifically identical in construction and are spaced at a predetermined distance from each other.

One cash box 100 to 300 each having two roll storage systems 102, 104 is housed in each of the first three receiving areas 44 to 48. In contrast, one cash box 400 with precisely one roll storage system 402 is housed in the fourth receiving area 50. The construction of the cash boxes 100, 200, 300 having the two roll storage systems is described in greater detail in what follows in conjunction with FIGS. 2 to 5. The construction of the cash box 400 with one roll storage system is known, for example, from document DE 10 2007 022 556 A1.

The receiving areas 44 to 50 are configured in such a manner that both cash boxes 100, 200, 300 with two roll storage systems 102, 104 and cash boxes 400 with only one roll storage system 402 can be housed optionally. To achieve this, cash boxes 100, 200, 300 with the two roll storage systems 102, 104 and cash box 400 with only the single roll storage system 402 specifically have the same dimensions. Further, the rails in particular by which cash boxes 100, 200, 300, 400 are retained in the receiving areas 44 to 50, and the connectors through which the electrical connection is made between the device 20 and cash boxes 100, 200, 300, 400, are located in the same positions in the case of cash boxes 100, 200, 300 with the two roll storage systems 102, 104 and in the case of cash box 44 with the single roll storage system 402.

As already described, each receiving area 44 to 50 comprises exactly two feed and removal units 28 to 42, wherein, in receiving area 44 to 48 in which a cash box 100, 200, 300 with two roll storage systems 102, 104 is accommodated, the feeding and removal of bank notes to or from the first roll storage system 102 takes place with the aid of the first removal units 28, and the feeding and removal of bank notes to or from the second roll storage system 104 of cash box 100 takes place with the aid of the second feed and removal unit 30 assigned to the corresponding receiving area 44 to 48.

If, on the other hand, a cash box 400 that comprises only one roll storage system is located in the receiving area 44 to 50, as shown in the case of receiving area 50, the feeding of bank notes to this roll storage system 404 and the removal of bank notes from this roll storage system 402 is carried out with the aid of only one predetermined feed and removal unit 40 for the receiving area 50.

In an alternative embodiment, more or fewer than four receiving areas 44 to 50 can be provided to receive one cash box each 100, 200, 300. For example, five receiving areas 44 to 50 or three receiving areas 44 to 50 can be provided. In addition, a cash box 100, 200, 300, 400 may be located in only one part of the receiving areas 44 to 50, and the remaining part of the receiving areas 44 to 50 may be empty. Furthermore, the equipping of the device 20 with cash boxes 100, 200, 300 having two roll storage systems 102, 104 and cash boxes 400 having only one roll storage system 402 may vary. For example, cash boxes 100, 200, 300 having two roll storage systems 102, 104 may be housed in two of the receiving areas 44 to 50, and cash boxes 400 having only one roll storage system 402 may be housed in the two other receiving areas 44 to 50. Further, cash boxes may additionally be provided in one of the receiving areas 44 to 50 or even in several of the receiving areas 44 to 50 in which the bank notes are kept, not on roll storage systems 102, 104, 402, but in stacked form.

By varying how the device 20 was equipped with cash boxes 100, 200, 300 with two roll storage systems 102, 104 and cash boxes 400 with only a single roll storage system 402, the number of roll storage systems 102, 104, 402 available for receiving bank notes can be adjusted easily to individual customer wishes without structural modifications to the device 20 being necessary. In the case of the embodiment shown in FIG. 1, a total of seven different roll storage systems 102, 104, 402 is available to receive bank notes so that bank notes of a Euro currency set can be stored unmixed, i.e. only bank notes of one denomination are accepted on the roll storage system 102, 104, 402. This has the advantage that at the time of disbursal a bank note of the desired denomination can be removed directly from the appropriate roll storage system. With mixed storage on the other hand, it may be necessary, if one requires a bank note of a specific denomination, for bank notes of other denominations that have been stored ahead of this bank note in the disbursal sequence of the appropriate roll storage system 102, 104, 402 to have to be likewise removed and buffered in specially provided interim storage.

In what follows, in conjunction with FIGS. 2 to 5, the construction of the cash boxes 100, 200, 300 with two roll storage systems 102, 104 will be described in detail in accordance with a first embodiment. In order to simplify the presentation, it will be shown using cash box 100 as an example. Cash boxes 200 and 300 are identical in construction to this first cash box 100.

Cash box 100 has a housing 106 by which the roll storage systems 102, 104 are protected and by which access to bank notes taken up on the roll storage systems 102, 104 is prevented. Two slots 110, 112 are provided in one wall 108 of the housing 106, wherein bank notes can be fed to the first roll storage system 102 through the first slot 110, or bank notes taken up on the first roll storage system 102 can be removed, and bank notes can be taken to the second roll storage system through the second slot 112, or the bank notes taken up on the second roll storage system can be removed. The slots 110, 112 are arranged specifically on the same side of the housing 106 at a predetermined distance from each other. The slots 110, 112 are preferably arranged in such a manner that when cash box 100 is housed in the receiving area 44 of the device 20, the first slot 110 is disposed in such a manner that bank notes can be transported through said slot with the aid of the first feed and removal unit 28, and the second slot 112 is disposed in such a manner that the bank notes can be transported through said slot with the aid of the second feed and removal unit 130.

Figure 4:
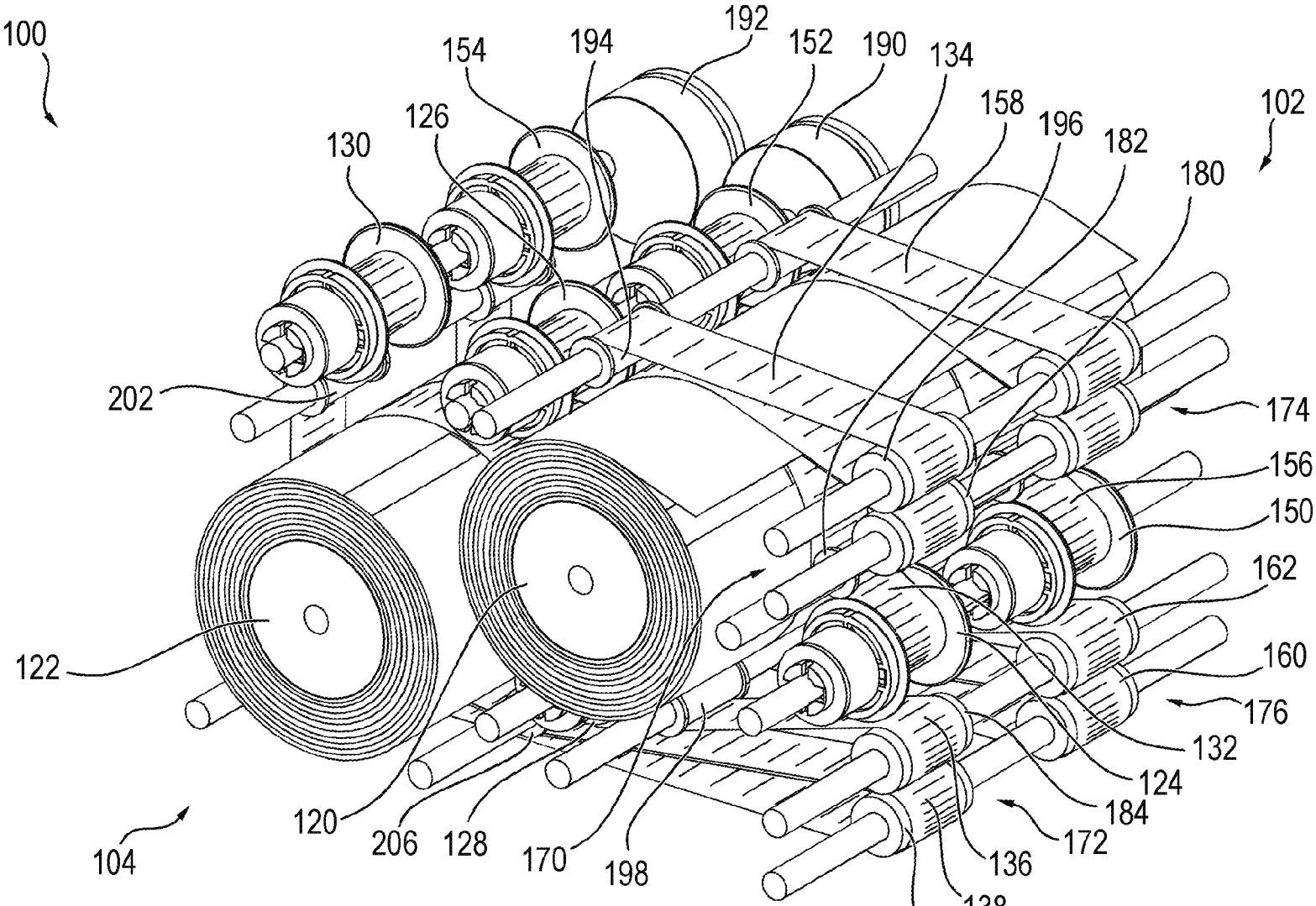
FIG. 4 shows a further schematic, perspective representation of the internal components of the cash box from FIGS. 2 and 3.
Figure 5:
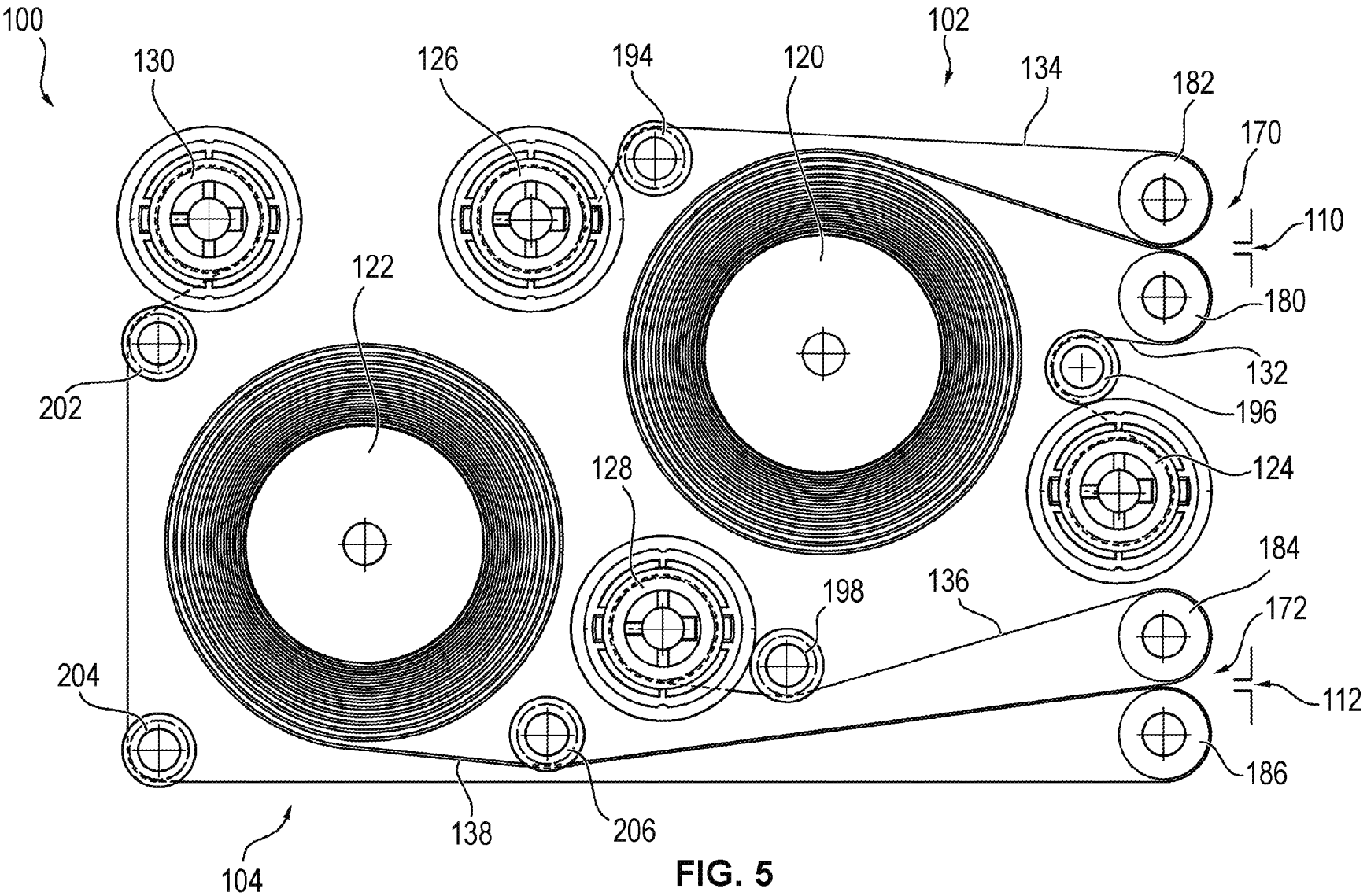
FIG. 5 shows a side view of the internal components of the cash box from FIGS. 2 to 4.

The housing 106 is blanked out in FIGS. 2 to 5 so that the components of cash box 100 arranged in the interior of the housing 106 are more easily visible. In FIGS. 4 and 5 side walls 101*a*, 101*b* of cash box 100 are additionally blanked out so that the construction and arrangement of the roll storage systems 102, 104 are clearly identifiable.

The first roll storage system 102 comprises a first winding drum 120, a first film reel 124, a second film reel 126, a fifth film reel 150, a sixth film reel 152, a first film tape 132, a second film tape 134, a third film tape 156, a fourth film tape 158, a first pair of rollers 170, and a second pair of rollers 174. Correspondingly, the second roll storage system 104 also comprises a second winding drum 122, a third film reel 128, a fourth film reel 130, a seventh film reel (not visible) and an eighth film reel 154, also a third film tape 136, a fourth film tape 138, a seventh film tape 160, an eighth film tape 162, a second pair of rollers 172, and a fourth pair of rollers 176.

Film reels 124, 126, 128, 130, 150, 152, 154, pairs of rollers 170 to 176 and film tapes 132, 134, 163, 138, 156, 158, 160, 162 are arranged symmetrically to a center plane of the roll storage systems 102, 104 so that in what follows only the front elements shown in FIG. 5 are described for purposes of simplifying the description. The explanations apply equally to the corresponding rear elements in FIG. 5 that are concealed by the respective front elements.

The first film tape 132 of the first roll storage system 102 is connected to the first film reel 124 and the first winding drum 120 and guided over a first roller 180 of the first pair of rollers 170. The second film tape 134 is connected to the first winding drum 120 and the second film reel 126 and guided over a second roller 182 of the first pair of rollers 170. The first slot 110 is disposed adjacent the first pair of rollers 170 so that the bank notes fed through first slot 110 are picked up between the two film tapes 132, 134 that are guided over the rollers 180, 182 of the first pair of rollers 170 and are spooled onto the first winding drum 120 together with the film tapes 132, 134. To do this, a first drive unit 90 is provided, specifically an electric motor with the aid of which the first winding drum 120, the rollers 180, 182 of the first pair of rollers 170 and/or the film reels 124, 126 can be driven. Depending on the direction of rotation of the winding drum 120, the film tapes 132, 134 and thus the bank notes are wound onto the winding drum 120 or unwound from the winding drum 120 and stored accordingly on the first roll storage system 102 or removed from the first roll storage system 102

The first film reel 124 is located on the side of the first winding drum 120 facing the first slot 110, whereas the second film reel 126 is located on the side of the first winding drum 120 facing away from the first slot 110. The first film tape 132 is taken over an idler pulley 196 to the first pair of rollers 170. Correspondingly, a further idler pulley 194 is provided over which the second film tape 134 is taken from the second film reel 126 to the first pair of rollers 170. This results in an especially compact structure for the first roll storage system 102, so that sufficient installation space is available in the cash box 100 to locate the second roll storage system without the dimensions for the cash box 100 having to be larger than in the case of cash box 400 in which only one roll storage system 402 is provided.

The third film tape 136 of the second roll storage system 104 is connected to the second winding drum 122 and to the third film reel 128 and taken over a third roller 184 of the second pair of rollers 172. Correspondingly, the fourth film tape 138 is connected to the second winding drum 122 as well as to the fourth film reel 130 and taken over a fourth roller 186 of the second pair of rollers 172. The second pair of rollers 172 is located adjacent the second slot 112 so that the bank notes fed through the second slot 112 of the cash box 100 are taken up between the two film tapes 136, 138 that are taken around the rollers 184, 186 of the second pair of rollers 172 and are wound onto the second winding drum 122 together with the film tapes 136, 138.

As in the case of the first roll storage system 102, a drive unit 192 is also provided in the case of the second roll storage system 104, with the aid of which the second winding drum 12, film reels 128, 130 and/or rollers 184, 186 of the second pair of rollers 172 can be driven. The second drive unit 192 also comprises specifically an electric motor.

The third film reel 128 and the fourth film reel 130 are specifically located on opposite sides of the second winding drum 122, where the third film reel 128 is preferably located on the side facing the second slot 112, and the fourth film reel 130 is located on the side facing away from the second slot 112.

The third film tape 136 is taken over an idler pulley 198 that is located between the third film reel 128 and roller 184 of the second pair of rollers 172. The fourth film tape 138 is taken over two idler pulleys 202, 204 whereby the fourth film tape 138 is taken past the second winding drum. Both film tapes together are taken over a further idler pulley 206 from the second pair of rollers 172 to the second winding drum 122. Overall this also results in a compact construction for the second roll storage system 104. The limited available space is well utilized and a high total holding capacity in bank notes for cash box 100 is achieved. In particular, a maximum of about one third of the bank notes can be held on the roll storage system 102, 104 of the maximum that can be held on the roll storage system 402 of cash box 400 with only one roll storage system 402. Thus, the total holding capacity of cash box 100 with two roll storage systems 102, 104 amounts to about two-thirds of the total holding capacity of cash box 400 with only the single roll storage system 402.

The components of the first roll storage system 102 and the components of the second roll storage system 104 are specifically arranged in such a manner that the components of the first roll storage system 102 are arranged on a first side of an imaginary diagonal plane through cash box 100 that, with reference to FIG. 5, runs from the top left to the lower right. Correspondingly, the components of the second roll storage system 104 are arranged specifically on the side of this imaginary diagonal plane opposite to the first side.

In an alternative embodiment, only two film tapes may be provided per roll storage system 102, 104 instead of four film tapes, wherein said two film tapes are advantageously configured wider than in the embodiment shown. As a further alternative more than four film tapes may be provided per roll storage system 102, 104, for example, six or eight film tapes. The number of film reels, pairs of rollers, and idler pulleys varies accordingly.

Figure 6:
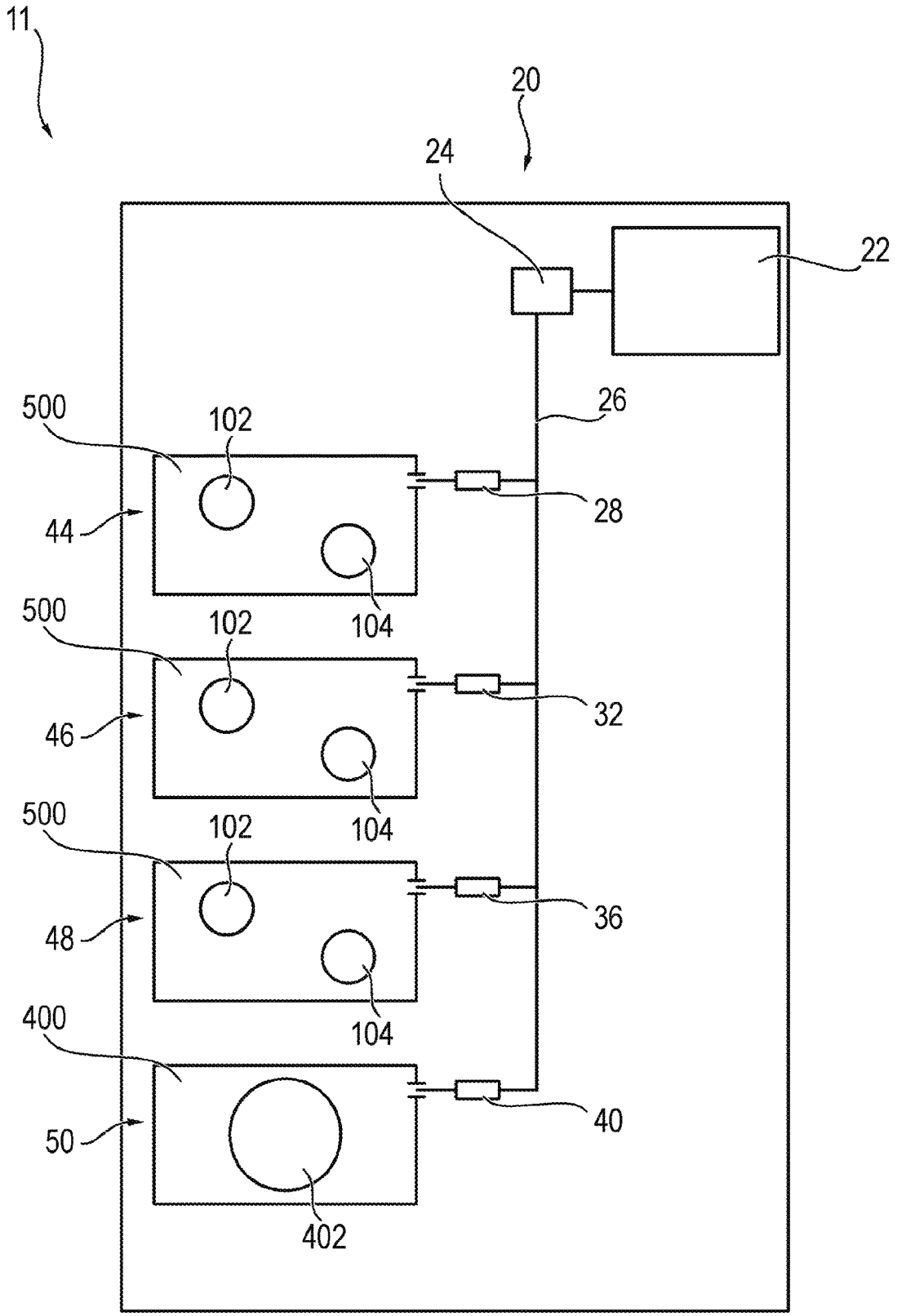
FIG. 6 shows a schematic representation of an array with a cash register system in accordance with a second embodiment and four cash boxes.

A schematic representation of a cash register system 11 in accordance with a second embodiment with four cash boxes 400, 500 is shown in FIG. 6. The cash register system 11 in accordance with the second embodiment differs from the cash register system 10 of the first embodiment from FIG. 1 in that only one feed and/or removal unit 28, 32, 36, 40 is provided for each receiving area 44 to 50.

The cash boxes 500 with the two roll storage systems 102, 104 located in the first receiving areas 44, 46, 48 are correspondingly configured differently from the cash boxes 100, 200, 300 of the first embodiment from FIGS. 1 to 5. The cash boxes 500 of the second embodiment have only a single slot 110 for feeding or removing bank notes, as described in greater detail below in conjunction with FIGS. 7 and 8.

The result is a particularly simple, compact construction for cash register system 11. In particular, the cash boxes 500 in accordance with the second embodiment can also be used in known cash register systems 11 in which previously only cash boxes 400 having only a single roll storage system 402 were used.

Figure 7:
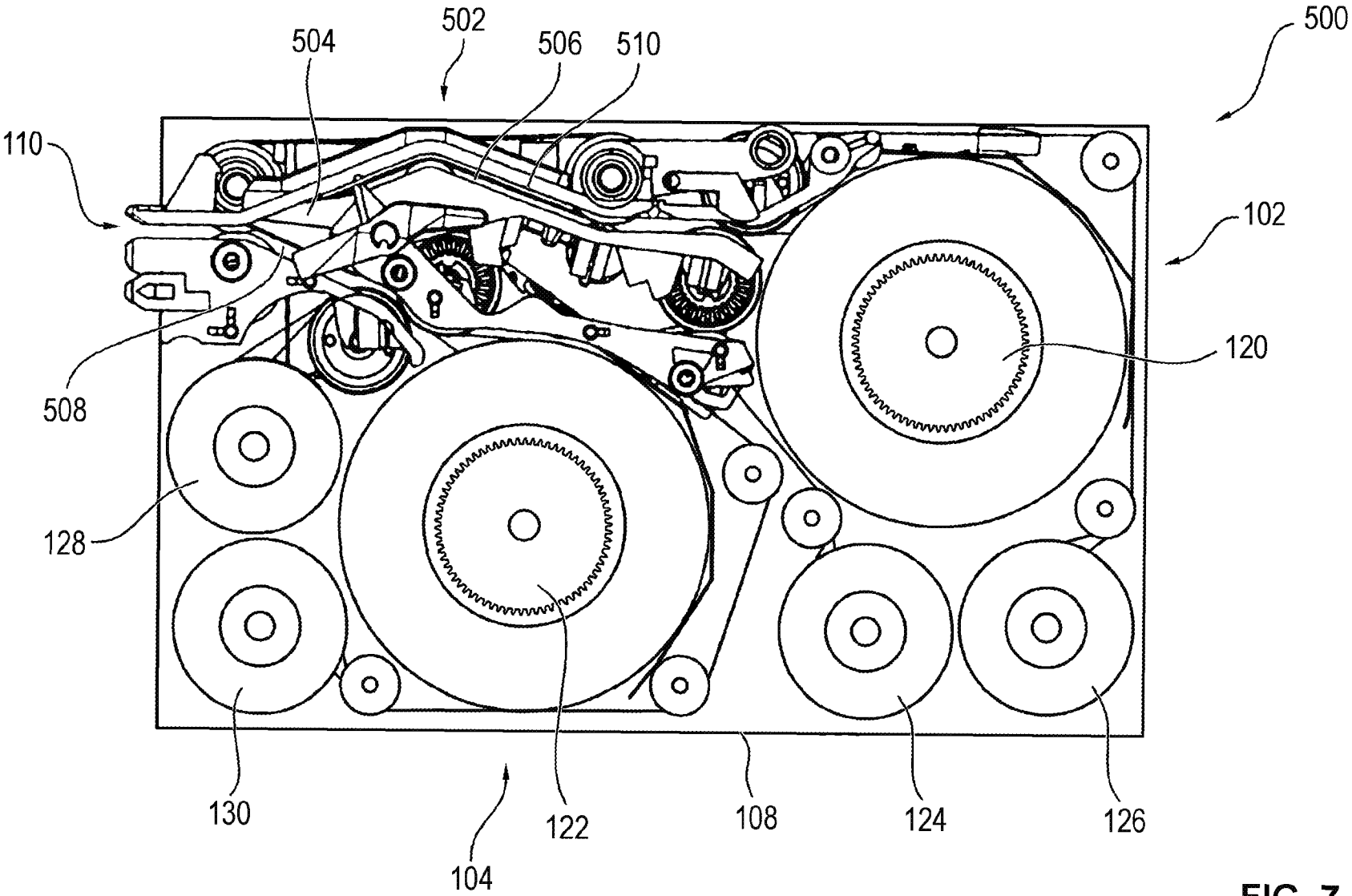
FIG. 7 shows a schematic representation of a cash box in accordance with a second embodiment.
Figure 8:
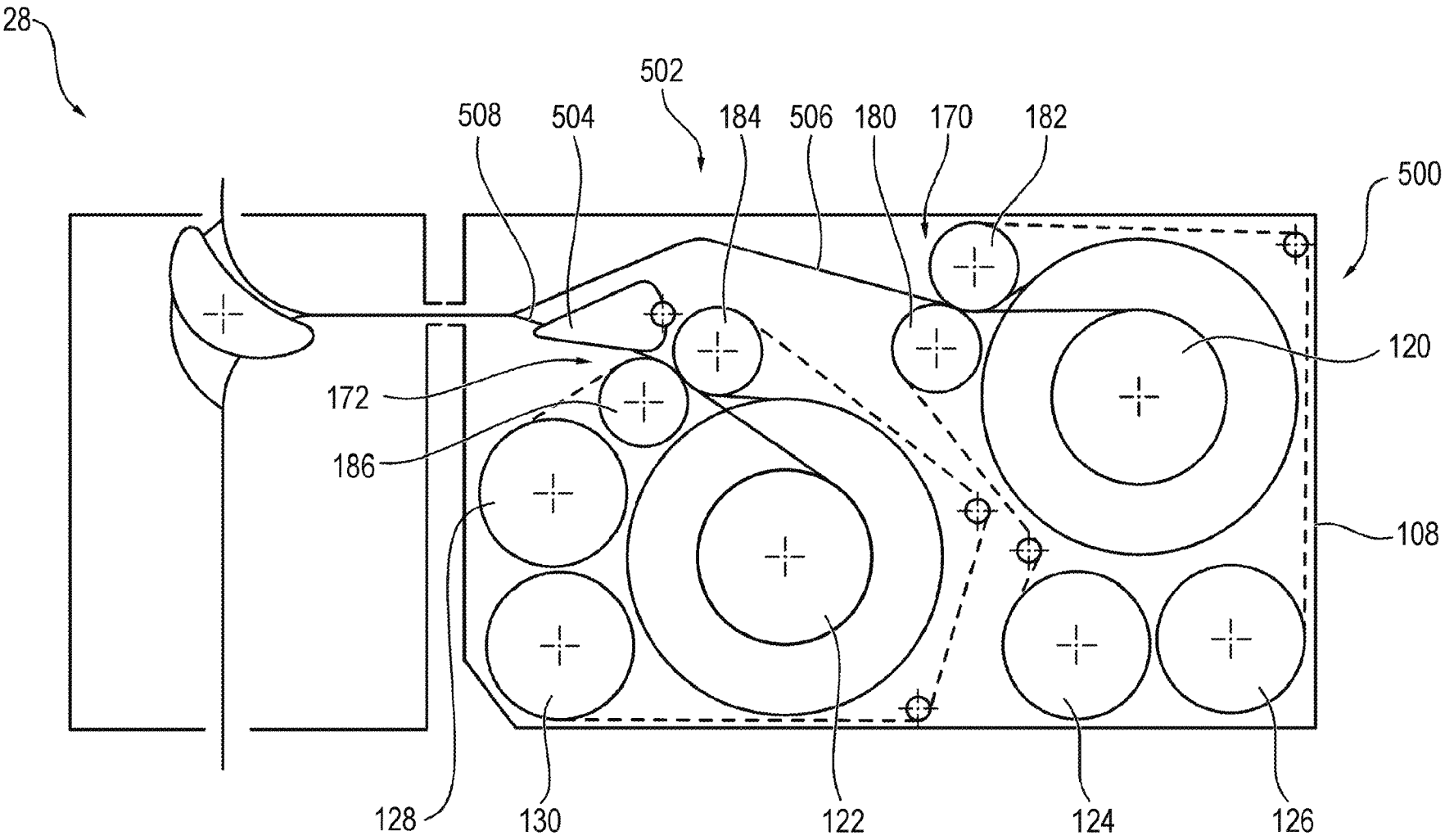
FIG. 8 shows a schematic, greatly simplified representation of the cash box from FIG. 7 and a feed and/or removal unit.

A schematic representation of a cash box 500 in accordance with the second embodiment is shown in FIG. 7. FIG. 8 shows a schematic representation of cash box 500 from FIG. 7 and a feed and/or removal unit 28, wherein the individual components of cash box 500 are shown greatly simplified for added clarity.

Cash box 500 has only a single slot 110 in its housing 106 through which bank notes to be brought to cash box 500 are brought both to the first roll storage system 102 as well as to the second roll storage system 104. In the same manner, bank notes removed from both a first roll storage system 102 and from the second roll storage system 104 are removed by way of a slot 110 of cash box 500.

In order to be able to feed the bank notes optionally to the two roll storage systems 102, 104, a switching array 502 is provided downstream from the slot 110. The switching array 502 comprises a switching element 504 which, in a first switch position, brings the bank notes fed in to a first path 506 for taking bank notes to the first roll storage system 102 and, in a second switch position, brings said bank notes to a second path 508 for taking bank notes to the second roll storage system 104. The second switch position is shown in FIG. 7, whereas the first switch position is shown in FIG. 8.

The two paths 506, 508 are specifically bounded by guide element 510, for example, guide plates, and guide the bank notes transported along them to the two pairs of rollers 170, 172 so that the bank notes fed in, as described previously in conjunction with the first embodiment, are in turn received between the first and second film tape 132, 134 or between the third and fourth film tape 136, 138 and spooled onto the winding drums 120 or 122.

In order to provide sufficient space for the switching array 502 in the immediate vicinity of the slot 110, the arrangement of the winding drums 120, 122 and of the film reels 124, 126, 128, 130 is modified in comparison with the first embodiment. The idler pulleys over which the film tapes 132 to 138, 156 to 162 are taken are correspondingly disposed differently. Thus, in the second embodiment, the first winding drum 120 is located with a greater distance to slot 110 than the second winding drum 122. In contrast to this, in the first embodiment the first winding drum 120 is located closer to the first slot 110 than the second winding drum 122 to the first slot 110 and the second slot 112.

The two film reels 124, 126 of the first roll storage system 102 are located immediately adjacent to each other in the second embodiment and provided in an area bounded by one corner of the housing 106 and the two winding drums 120, 122. The two film reels 128, 130 of the second roll storage system 104 are similarly located immediately next to each other and between the side of the housing 106 of the cash box 500, in which slot 110 is located, and the second winding drum 122. In this way, a particularly compact, space-saving structure is achieved, so that in spite of the provision of the switching array 502 inside cash box 500 both the first roll storage system 102 and the second roll storage system 104 have a relatively large capacity.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A device for handling bank notes, having an input and/or output unit to input and/or output bank notes to an operator, comprising: a receiving area to accommodate a device having a housing and a first roll storage system disposed inside the housing for storing bank notes, wherein a second roll storage system is accommodated for storing bank notes, wherein a first slot is provided in a wall of the housing for feeding bank notes to the first roll storage system and a second slot is provided for feeding bank notes to the second roll storage system, a first feed and/or removal unit to feed or remove bank notes through the first slot of the device, a second feed and/or removal unit to feed or remove bank notes through the second slot of the device, and a transport unit to transport bank notes between the input and/or output unit and the feed and/or removal units.

2. The device of claim 1, wherein the first roll storage system comprises a first winding drum, a first film reel, a second film reel, a first film tape connected to the first winding drum and to the first film reel and a second film tape connected to the first winding drum and to the second film reel, and wherein the second roll storage system comprises a second winding drum, a third film reel, a fourth film reel, a third film tape connected to the second winding drum and to the third film reel, and a fourth film tape connected to the second winding drum and to the fourth film reel.

3. The device of claim 2, wherein a first pair of rollers and a second pair of rollers are provided, wherein the first film tape is led over a first roller of the first pair of rollers and the second film tape is led over a second roller of the first pair of rollers, wherein a switching array in a first switching position routes the bank notes fed in through the first slot to the first pair of rollers in such a manner that the bank notes are arranged between the first film tape and the second film tape, wherein the third film tape is taken over a third roller of the second pair of rollers, and the fourth tape is taken over a fourth roller of the second pair of rollers, and wherein the switching array in a second switching position routes the bank notes fed through the first slot in such a manner that the bank notes are arranged between the third film tape and the fourth film tape.

4. The device of claim 3, wherein the first film tape, the second film tape, the third film tape and/or the fourth film tape are each taken over at least one deflecting element.

5. The device of claim 4, wherein the second film tape is taken past the first winding drum with the aid of at least one idler pulley at a predetermined angle.

6. The device of claim 5, wherein the fourth film tape is taken past the second winding drum with the aid of at least one idler pulley at a predetermined angle.

7. The device of claim 2, wherein the first winding drum is located at a first distance from the first slot and the second winding drum is located at a second distance from the second slot and wherein the second distance is greater than the first distance.

8. The device of claim 1, wherein the first slot and the second slot are located on the wall of the housing at a predetermined distance from each other.

9. The device of claim 1, wherein a first pair of rollers and a second pair of rollers are provided, wherein a first film tape is guided over a first roller of the first pair of rollers and a second film tape is guided over a second roller of the first pair of rollers, wherein the bank notes fed through the first slot are led between the first and second rollers of the first pair of rollers, so that the bank notes are arranged between the first film tape and the second film tape, wherein a third film tape is taken over a third roller of the second pair of rollers and a fourth film tape is taken over a fourth roller of the second pair of rollers, wherein the bank notes brought in through the second slot are led between the third and fourth rollers of the second pair of rollers so that the bank notes are arranged between the third film tape and the fourth film tape.

10. The device of claim 9, wherein a first winding drum is between a first film reel and a second film reel, and wherein the first pair of rollers and the first film reel are on a same side of the first winding drum.

11. The device of claim 10, wherein a second winding drum is between a third film reel and a fourth film reel, and wherein the third film reel and the second pair of rollers are on a same side of the second winding drum.

12. A device for handling bank notes, having an input and/or output unit to input and/or output bank notes to an operator, comprising: a receiving area to accommodate a device having a housing and a first roll storage system disposed inside the housing for storing bank notes, wherein a first slot is provided in a wall of the housing for feeding bank notes to the first roll storage system, a first feed and/or removal unit to feed or remove bank notes through the first slot of the device, and a transport unit to transport bank notes between the input and/or output unit and the feed and/or removal unit, wherein the receiving area is configured in such a manner and the first feed and/or removal unit is located in such a manner that the device with the first roll storage system is installed in the receiving area, wherein the bank notes are fed to or removed from the device with the first roll storage system by way of the first feed and/or removal unit.

13. A device for handling bank notes, having an input and/or output unit to input and/or output bank notes to an operator, comprising: a first receiving area to accommodate a first device having a first housing and a first roll storage system disposed inside the first housing for storing bank notes, and a second receiving area to accommodate a second device having a second housing and a second roll storage system disposed inside the second housing for storing bank notes, wherein a first slot is provided in a wall of the housing for feeding bank notes to the first roll storage system and a second slot is provided for feeding bank notes to the second roll storage system, a first feed and/or removal unit to feed or remove bank notes through the first slot of the device, a second feed and/or removal unit to feed or remove bank notes through the second slot of the device, and a transport unit to transport bank notes between the input and/or output unit and the feed and/or removal units.

* * * * *